US007168421B2

(12) United States Patent
Blom

(10) Patent No.: US 7,168,421 B2
(45) Date of Patent: Jan. 30, 2007

(54) CRANKCASE VENTILATION

(75) Inventor: Christer Blom, Tumba (SE)

(73) Assignee: Saab Automobile AB (SE)

( * ) Notice: Subject to any disclaimer, the term of this patent is extended or adjusted under 35 U.S.C. 154(b) by 0 days.

(21) Appl. No.: 11/118,663

(22) Filed: Apr. 29, 2005

(65) Prior Publication Data

US 2005/0241310 A1 Nov. 3, 2005

(30) Foreign Application Priority Data

Apr. 29, 2004 (SE) ..... 0401105

(51) Int. Cl.
*F02B 25/06* (2006.01)
*F01M 13/00* (2006.01)
*F01M 13/02* (2006.01)

(52) U.S. Cl. ..... 123/573; 123/572

(58) Field of Classification Search ..... 123/572–574; *F02M 25/06, 13/00, 13/02*
See application file for complete search history.

(56) References Cited

U.S. PATENT DOCUMENTS 3,418,986 A * 12/1968 Scherenberg ..... 123/559.1
4,528,969 A * 7/1985 Senga ..... 123/572
4,768,493 A 9/1988 Ohtaka et al. ..... 123/573
6,044,829 A 4/2000 Butz et al. ..... 123/573
6,123,061 A * 9/2000 Baker et al. ..... 123/573
6,390,080 B1 5/2002 Dowding et al. ..... 123/572
6,412,479 B1 7/2002 Canfield et al. ..... 123/573
7,014,421 B2 * 3/2006 French ..... 415/197

FOREIGN PATENT DOCUMENTS

DE 4213047 A1 * 10/1993
DE 2532131 A1 * 3/1997
DE 19754197 A1 * 6/1999
DE 10043796 A1 * 3/2002
DE 10226694 A1 * 12/2003
DE 1004031281 A1 * 1/2006

* cited by examiner

*Primary Examiner*—Thai-Ba Trieu
(74) *Attorney, Agent, or Firm*—Ostrolenk, Faber, Gerb & Soffen, LLP

(57) ABSTRACT

A combustion engine for a vehicle, comprising a compressor to which charged air is to be supplied for supercharging, wherein the engine is provided with a device for venting exhaust gases from the crankcase of the engine to the compressor, and the venting device comprises a throttle element for securing a desired pressure level in the crankcase. The throttle element is arranged in thermal cooperation with the compressor.

5 Claims, 1 Drawing Sheet

CRANKCASE VENTILATION

TECHNICAL FIELD

The present invention relates to a combustion engine for a vehicle, comprising a compressor to which charged air is to be supplied for supercharging, wherein the engine is provided with a device for venting exhaust gases from the crankcase of the engine to the compressor, which device comprises a throttle element for securing a desired pressure level in the crankcase.

BACKGROUND

In a supercharged combustion engine, a certain amount of leakage of fully or partly combusted exhaust gases always occur between the piston rings and the cylinder wall to the crankcase during the compression steps of the combustion engine. This exhaust gas leakage is generally referred to as blow-by, even though the gases also contain condensate from the engine oil in the crankcase. To prevent unfiltered exhaust gases from being discharged directly to the environment, these exhaust gases are ventilated to the intake system of the engine for combustion in the cylinders. This principle is generally referred to as PCV, Positive Crankcase Ventilation.

The blow-by gases are supplied directly from the crankcase, via a hose or the like, to the inlet in the air duct between the turbo compressor and the air filter. Alternatively, the exhaust gases are first supplied to the cylinder head cover (which is in fluid communication with the crankcase via the transmission between the crankshaft and the camshaft(s)). The underpressure that prevails upstream the compressor provide for this blow-by gas ventilation.

During driving situations when the engine works hard, a powerful suction is created upstream the compressor. To avoid a too large underpressure in the crankcase, which can result in an increased blow-by, a throttle element is arranged in the hose.

It forms a flow resistance in the hose which can be adapted for adjusting the evacuated amounts of exhaust gases as desired.

One example of this known PCV-principle is shown in FIG. 1, which schematically depicts a multi-cylinder combustion engine 1 of type Otto. The cylinders 3 of the engine are provided with not shown exhaust gas valves, leading the exhaust gases to a exhaust gas collector 5 which is shared in common by the cylinders. The engine is adapted for supercharging by means of an exhaust gas driven turbo compressor having a turbine 7 and a compressor 9 driven by the turbine 7. The turbine is supplied from the exhaust gas collector 5 and is in fluid communication, via an exhaust gas duct 11, with a conventional catalytic converter 13 and one or several not shown sound absorbers. The inlet 15 of the compressor is connected to an air filter 17 arranged upstream for filtering the charged air that is supplied to the compressor. The outlet of the compressor is connected to a cooler 19 for cooling the compressed charged air before it is further supplied to the cylinders 3 of the engine.

The combustion engine is provided with a PCV-device 21 (shown with dashed lines), which is intended to ventilate the exhaust gases from the crankcase. A throttle element 23 is arranged in the PCV-device and serves to control the amount of blow-by gases that are ventilated from the crankcase. During the operation of the engine, the underpressure that prevails just upstream the compressor will draw air from the environment via the air filter 17, but also from the crankcase via the PCV-device 21. In driving situations when the compressor 9 works hard (and thus creates a more powerful suction just upstream the compressor), the throttle element 23 will provide an efficient flow resistance in the PCV-device 21 preventing the pressure from decreasing too much in the crank case, which could result in an increased blow-by. During wintertime driving, or during other cold conditions, condensate is easily formed in the crankcase which can be transformed into ice. A particular critical place is as mentioned before the throttle element 23 in the PCV-device 21.

However, during some driving conditions the water content in the blow-by gases creates large amounts of condensation water, e.g. during wintertime or during frequent starts and stops of the engine. This formation of condensate can cause great problems if freezed to ice. A particularly critical place is the throttle element in the hose, and since an underpressure prevails, ice may also be formed at temperatures of several degrees above zero. Besides that the crankcase ventilation can be blocked by an ice plug leading to drainage of engine oil, the ice plug may also when it finally melts loose the grip and join the blow-by gas flow into the compressor, which can lead to damages of the compressor wheel.

RELATED ART

U.S. Pat. Nos. 6,412,479 and 6,390,080 both use different types of PCV-systems. To avoid the formation of ice, they use a heat pipe for leading heat from e.g. the cooling liquid or the exhaust gas system for heating the PCV-system.

U.S. Pat. No. 6,044,829 discloses an electrical heating element for preventing ice formation in the PCV-system. The disadvantage with such a heating principle is that it requires an electrical current as well as some form of control equipment for preventing over heating.

U.S. Pat. No. 4,768,493 uses a separate circuit for circulating a cooling liquid around a PCV-valve. This separate circuit implies the use of extra pipes.

The systems described above are bulky and expensive.

THE OBJECT OF THE INVENTION

An object of the present invention is to prevent the formation of ice in the throttle element included in the PCV-system in a simple way.

SUMMARY OF THE INVENTION

This object is achieved by means of a combustion engine as initially defined and which is characterised in that the throttle element is arranged in thermal cooperation with the compressor. Hereby, the formation of ice will not arise. Since the formation of ice only arises after a moment's driving, the compressor material have time to get heated by the heat generated during the compression, as well as get distributed via the compressor material to the throttle element.

Preferably, the compressor comprises an intake to which the device is connected, and which intake is in fluid communication with the inlet of the compressor, whereby the throttle element is arranged in the intake. Hereby the nearness to the heat source is short.

Suitably, the intake forms a recess in the compressor housing. Hereby is achieved a robust and stabile construction, and the throttle element is well protected from exterior stresses. Robust constructions are advantageous when emission related constructions are to be concerned, since national laws regulating emissions and the like often put great demands on stability and robustness.

Preferably, the recess extends in radial direction with reference to the longitudinal direction of the inlet. Hereby is achieved that connections to the recess will not interfere with connections to the air inlet of the compressor.

Suitably, the throttle element constitutes a contraction of the cross section of the recess, and preferably the recess has a section with a first diameter and a second section with a second, smaller diameter. Hereby a simple and robust design of the throttle element will be allowed. Furthermore, it will be simple to modify the compressor.

SHORT DESCRIPTION OF THE DRAWINGS

The invention will now be described with reference to accompanying drawings, on which:

FIG. 1 schematically shows a drawing of the PCV-principle according to related art.

FIG. 2 schematically shows a drawing of the PCV-principle according to the invention.

DESCRIPTION OF A PREFERRED EMBODIMENT OF THE INVENTION

Figure 1:
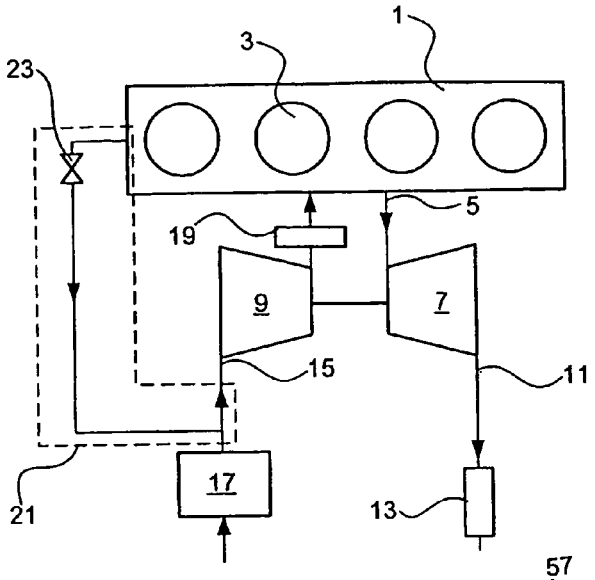
Fig. 1 PRIOR ART
Figure 2:
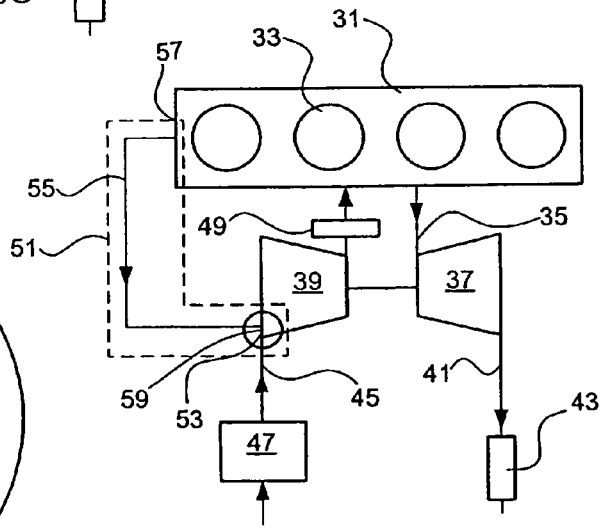

FIG. 2 schematically shows a multi-cylinder combustion engine 31 of type Otto according to the invention. The cylinders 33 of the engine have not shown exhaust gas valves guiding the exhaust gases to an exhaust gas collector 35 which is shared in common by the cylinders. The engine is supercharged by means of an exhaust gas driven turbo compressor provided with a turbine 37 and compressor 39 which is driven by the turbine. The turbine is supplied from the exhaust gas collector 35 and is in communication by means of an exhaust gas duct 41 with a catalytic converter 43 and one or several not shown sound dampers. Upstream the compressor, an inlet 45 is connected to an air filter 47 for filtering the charged air that is supplied to the compressor. The outlet of the compressor is connected to a cooler 49 for cooling the compressed charged air before it is fed to the cylinders of the engine.

The engine according to FIG. 2 is provided with a PCV-device 51 (shown with dashed lines) and serves to ventilate blow-by gases from the crankcase. A throttle element (see FIG. 3–4) is arranged in the PCV-device 51 and serves to control the amount of blow-by gases which is ventilated from the crankcase.

During operation of the engine, the underpressure which is created just upstream the compressor will draw air from the environment via the air filter 47, but also from the crankcase via the PCV-device 51. During those driving situations when the compressor 39 works hard (and thus creates a more powerful suction upstream the compressor), the throttle element 53 will offer an efficient flow resistance in the PCV-device 51 which prevents the pressure from decreasing too much in the crankcase which thereby could result in an increased blow-by.

The PCV-device according to FIG. 2 comprises a ventilation duct 55 intended to lead blow-by gases from the crankcase to the compressor 39. A first end 57 of the duct 55 is connected to the crankcase (alternatively to the cylinder head cover if the crankcase and the cylinder head cover are in fluid communication with each other), and the other, opposite end 59 is connected to the inlet nose 61 of the compressor.

Figure 3:
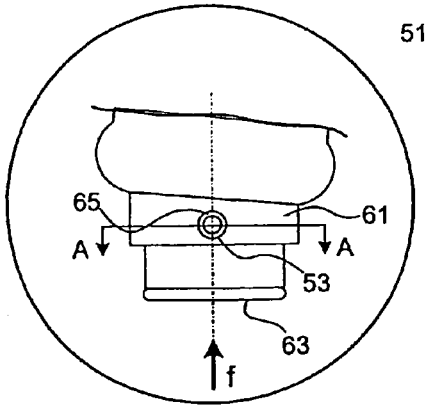
FIG. 3 shows an enlarged view of the inlet nose of the compressor.

FIG. 3 shows an enlarged view of the inlet nose 61 of the compressor (the encircled area in FIG. 2). Air from the air filter 47 is fed into the compressor 39 in the direction of the arrow f via an inlet opening 63. A separate intake 65 intended for blow-by gases is also formed in the inlet nose of the compressor. The intake is formed as a circular recess 65 and leads into the inlet at a small distance from the inlet opening 63. The recess 65 extends in the radial direction in relation to the flowing direction f. In this recess the second end 59 of the ventilation duct 55 is arranged.

Figure 4:
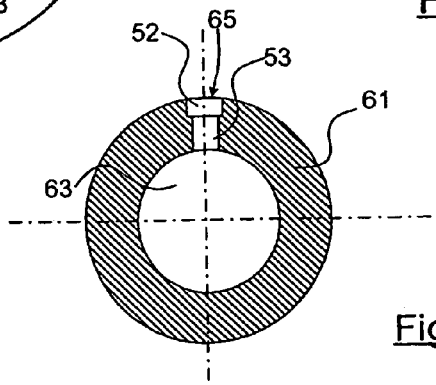
FIG. 4 shows a sectioned view along the line A—A in FIG. 3.

In FIG. 4 it is disclosed that the circular recess 65 has a first section 52 and a second section 53, seen in the longitudinal direction of the recess. The first section 52 has a first diameter and the second section has a second, smaller diameter. The second section is arranged farthest in, seen in the radial direction, i.e. closest to the inlet of the compressor. The second section forms the throttle element 53. By adapting the diameter of the second section 53, the flow into the compressor 39 can be controlled so as to avoid a too high underpressure in the crankcase, independently of the compressor power. Apart from known throttle elements adapted for hoses and ducts, this one is formed directly in the casting of the compressor housing, which gives the throttle element 53 a superior stability and reliability.

During operation of the engine, the heat that is generated by the work of the compressor 39 will be distributed in the whole compressor housing and thus also to the area that surrounds the recess 65, i.e. also to the throttle element 53. It is not unusual that the compressor reaches a temperature, at the inlet nose, of several tens of centigrade, which is more than enough for avoiding the formation of ice.

The invention claimed is:

1. A combustion engine for a vehicle, comprising a compressor to which charged air is to be supplied for supercharging;

crankcase of the engine; and a device for venting exhaust gases from the crankcase of the engine to the compressor, the venting device comprising a throttle element for securing a desired pressure level in the crankcase, wherein the compressor comprises an intake to which the venting device is connected, and the intake is in fluid communication with an inlet of the compressor, and the throttle element is arranged in the intake.

2. The combustion engine according to claim 1, wherein the intake forms a recess in the compressor housing.

3. The combustion engine according to claim 2, wherein the recess extends in a radial direction in relation to a longitudinal direction of the inlet.

4. The combustion engine according to claim 2, wherein the throttle element comprises a contraction of the cross-section of the recess.

5. The combustion engine according to claim 2, wherein the recess has a first section with a first diameter and a second section with a second diameter smaller than the first.

* * * * *